United States Patent [19]

Makin

[11] Patent Number: 4,825,608

[45] Date of Patent: May 2, 1989

[54] FLUSH MOUNTED SELF-FLASHING DUAL PANE SKYLIGHT

[76] Inventor: Brent A. Makin, 265 S. 400 West, Salem, Utah 84653

[21] Appl. No.: 28,873

[22] Filed: Mar. 23, 1987

[51] Int. Cl.[4] ..... E04D 3/38; E04B 7/18

[52] U.S. Cl. ..... 52/200; 52/58; 52/790

[58] Field of Search ..... 52/200, 198, 199, 58, 52/208, 788, 790, 72, 304

[56] References Cited

U.S. PATENT DOCUMENTS

| | | | |
|---|---|---|---|
| 3,434,250 | 3/1969 | Kiekhaefer | 52/200 |
| 3,455,073 | 7/1969 | Kiekhaefer | 52/200 |
| 3,918,226 | 11/1975 | Naidus | 52/200 |
| 4,173,854 | 11/1979 | Wallerstein | 52/200 |
| 4,512,119 | 4/1985 | Willoughby | 52/58 |
| 4,514,944 | 5/1985 | Doell | 52/200 |
| 4,527,368 | 7/1985 | Jentoft | 52/200 |
| 4,537,004 | 8/1985 | Anderson | 52/788 |
| 4,548,006 | 10/1985 | Roberts, Jr. | 52/200 |
| 4,589,238 | 5/1986 | Sampson et al. | 52/200 |
| 4,649,685 | 3/1987 | Wolf et al. | 52/790 |

FOREIGN PATENT DOCUMENTS

| | | | |
|---|---|---|---|
| 1434133 | 9/1969 | Fed. Rep. of Germany | 52/200 |
| 1477844 | 4/1967 | France | 52/200 |

OTHER PUBLICATIONS

Architectural Record; Jan. 1956 (p. 63).

*Primary Examiner*—Michael Safavi

*Attorney, Agent, or Firm*—Thorpe, North & Western

[57] ABSTRACT

A self flashing dual pane skylight for flush mounting on a roof having an inclined slope is disclosed. The skylight is preferably rectangular and is made up of upper and lower light transmitting panes having two mutually opposed side edges and opposed top and bottom edges. The upper pane preferably contains a convexly curved dome. The panes are separated by spacer means secured between them located parallel to the outer perimeter edges of the panes and spaced inwardly from these edges a predetermined distance. A dead airspace between the upper and lower panes is formed inwardly of the spacer means and a flashing channel is formed around the outer perimeter between the panes outwardly of the spacer means. Flashing means is secured in the flashing channel by a resilient sealing matrix. The flashing extends outwardly from the channel a predetermined distance to form a continuous flashing border for attaching the skylight to the roof. The flashing in the channel is surrounded by the sealing matrix and is separated from the spacer a small distance to allow for thermal expansion and contraction of the skylight relative to the flashing. The skylight is preferably made of an high impact plastic. Installation can be easily accomplished by placing the edges of the skylight over an opening in a roof, nailing the flashing to the roof structure and shingling over the flashing and perimeter edges of the skylight at the top and sides thereof.

6 Claims, 2 Drawing Sheets

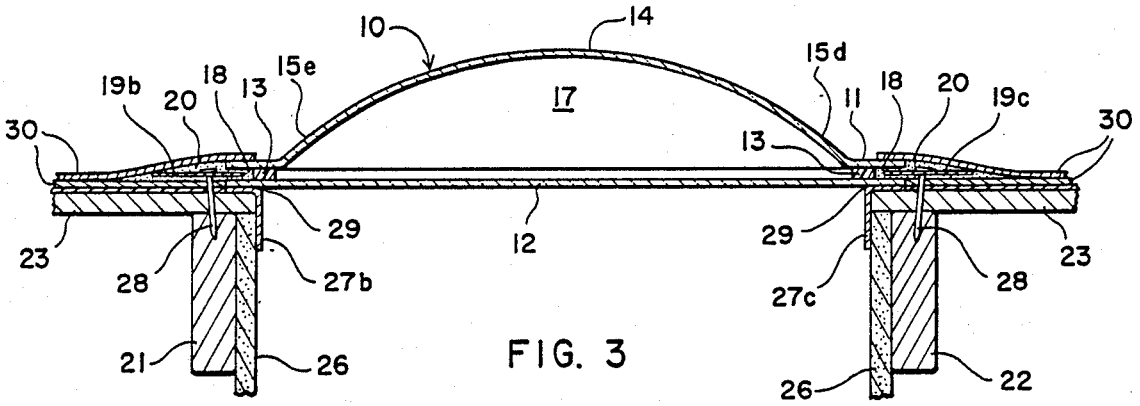
FIG. 3
FIG. 4
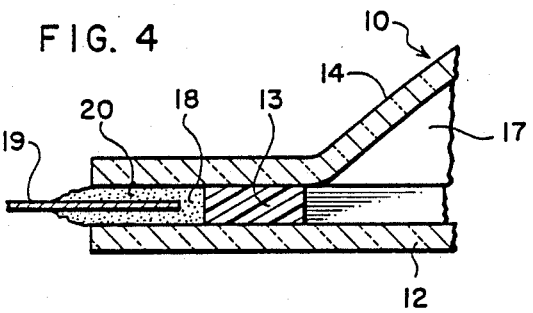
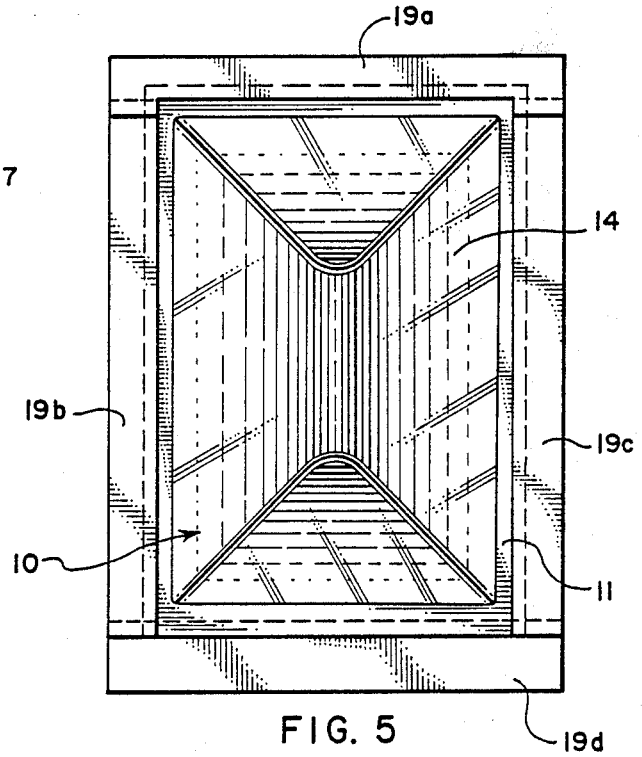
FIG. 5
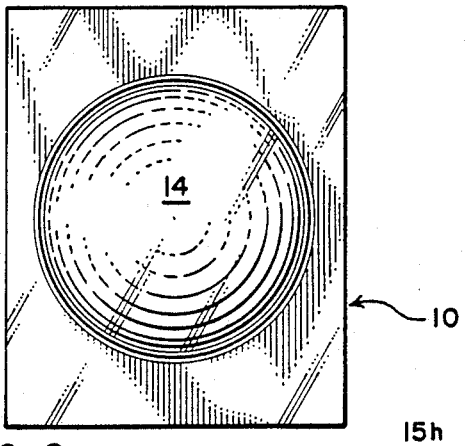
FIG. 6a
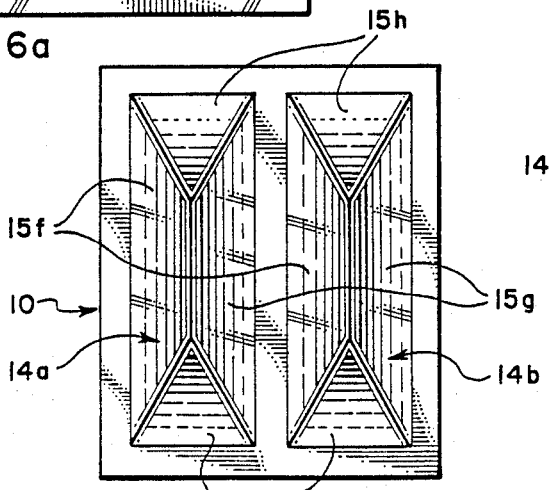
FIG. 6b
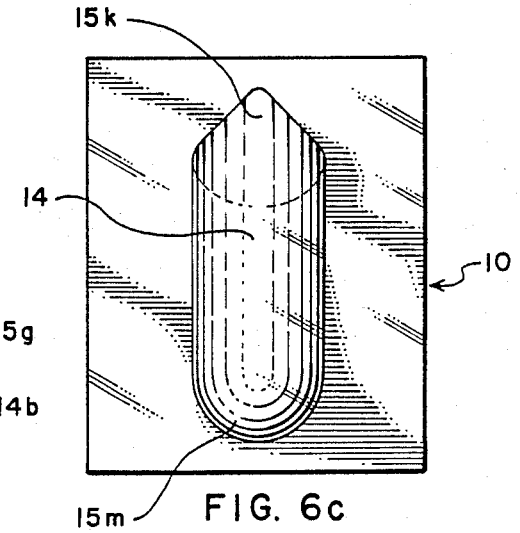
FIG. 6c

FLUSH MOUNTED SELF-FLASHING DUAL PANE SKYLIGHT

BACKGROUND OF THE INVENTION AND DESCRIPTION OF PRIOR ART

This invention relates to a flush mounted, self-flashing skylight to be mounted on a roof of inclined slope. More particularly, this invention relates to a flush mounted, self-flashing skylight for mounting on roofs of inclined slope where the skylight is free floating in the flashing to allow for thermal expansion and contraction of the skylight relative to the flashing when the flashing is permanently attached to the roof structure.

There have been many designs for improving conventional skylights. Many of the problems have been associated with providing adequate sealing of the skylight structure to the roof without leaking. The configuration of conventional skylights is generally rectangular with the skylight itself being flat or convexly curved. Most skylights are made of a light-transmissive material which may be clear or translucent. Most are made of a high impact, thermally expandable, plastic such as acrylics, polycarbonates and the like. Some are also made of glass. Most skylights are mounted in a framework or curb that is to be inserted through the roof structure. Some units have been stated to be "self-flashing" in that the skylight unit contains outwardly extending flanges over which is laid the roofing material to provide a more waterproof joint between the skylight and the roof. However, because most skylights are domed structures, rain water is often deflected around and down the skylight toward the edges where the joints between the skylight and the roof may permit leakage. This is stated to be particularly troublesome at the bottoms of skylights since water running over the skylight may be directed under the roofing material. U.S. Pat. No. 4,548,006 attempts to overcome this problem by providing a self-flashing structure wherein the skylight has flanged side edges and a raised lower end. Rain water is directed down the skylight between the raised flanges and "ski jumps" over the raised end. However, this doesn't really solve the leaking problem since water that doesn't "ski-jump" off the end, falls directly at the juncture of the skylight and the roofing shingles. Since the shingles overlap the skylight flanges, water can still work its way under the shingles.

Various methods of providing sealing around skylights are taught in the art. Conventionally, a skylight is secured to a roof with the use of roofing mastic consisting of an asphaltic or resinous material. A roof opening is made, the roofing mastic applied on the deck around the opening and the flange, surrounding the curb frame to which the skylight is attached, is placed over the mastic and firmly pressed to create a seal. The flange is nailed to the roof and additional mastic is applied. Shingling is then completed around the skylight curb frame.

This method is messy and not very effective unless properly done. It is difficult for a "do it yourself" application because the seal between the mastic and the curb frame must be perfect if leakage is to be avoided. Various means to improve upon the conventional method are disclosed in U.S. Pat. Nos. 3,455,073; 4,527,368 and 4,589,238. However, none of these relate to flush mounted skylights in that all are contained on a curb frame that extends above the roof surface.

A single pane skylight is disclosed in U.S. Pat. No. 4,173,854 which requires the use of bow members having convex upper edges over which is placed flashing which must be accurately bent at various angels to accommodate the convex upper surface and vertical side surface of the bow members and also the flat rafter or sheathing surface on which the bow members rest. Also, the light transmitting skylight cover itself must be oversized relative to the roof opening and secured to the roof surface with screws or other fastening means. Unless very accurately installed, the attachments of the skylight cover and flashing present numerous leakage problems. For example, the thermal expansion and contraction of the plastic skylight cover can cause the screws, with which it is secured to the roof, to work loose and cause leakage.

Provisions for thermal expansion or contraction are not generally made in prior art devices. A rolling seal arrangement to provide for thermal expansion in skylights mounted in a curb frame is described in U.S. Pat. No. 3,455,073.

Although there is considerable art in skylight technology, there has not heretofore been available a simple, inexpensive, self-flashing, water-tight, flush mountable dual pane skylight.

OBJECTS AND BRIEF SUMMARY OF THE INVENTION

It is therefore an object of the present invention to provide for a water-tight, self-flashing dual pane skylight which can be mounted flush with an inclined roof surface without requiring a curb frame.

It is also an object of this invention to provide for a water-tight, self-flashing skylight wherein the skylight is free floating in the flashing to allow for thermal expansion or contraction of the light transmitting skylight material.

Another object of this invention is to provide a self-flashing, dual pane skylight wherein the skylight is flush mounted in the roof in such a manner that the flashing is utilized as an extension of the shingles to allow for a water resistant installation.

These and other objects may be realized by means of a dual pane structure generally consisting of upper and lower panes of light transmitting material having the same outside perimeter dimensions, (preferably rectangular) wherein the panes are separated by means of spacers sandwiched between the panes in generally parallel position relative to the outside edges of the panes but being located inwardly therefrom a predetermined distance. With the spacers being so located, they form a continuous seal between the two panes inwardly from their perimeters, thereby creating a dead air space between the panes inwardly of the spacers and a flashing channel outwardly thereof.

The flashing channel is sufficiently deep that flat strips of flashing can be imbedded in the channel in a resilient sealing matrix and extend outwardly of the channel to form a flat flange surface which is attachable to the roof structure. The flashing extends into the channel almost to the spacers and is surrounded by the resilient sealing matrix which allows the flashing and skylight panes to float relative to each other within the channel as the panes thermally expand or contract. This allows the flashing to be permanently attached to the roofing and be covered at the top and sides of the skylight structure by shingles with the flashing serving as an extension of the shingles. The lower portion of the flashing also serves as an extension of the shingles and does not require that the lower flashing be covered by a row of shingles. Rather, the lower flashing overlaps the next lower shingle row. Thus, the skylight structure is flush mounted to the roof and water running down the skylight and around the sides is not backed up by the skylight structure nor is there any significant leakage. Of course, it may still be desirable to place a sealing material about, i.e. under, over or both, the flashing as an added precaution against leakage.

The upper skylight pane will preferably be convex and various domed shapes will be presented in the detailed description that will hasten water flow off the skylight.

DESCRIPTION OF THE DRAWINGS

FIG. 3 is a transverse cross sectional view taken along lines 3—3 of FIG. 1.

FIG. 4 is an enlarged fragmentary cross sectional view of one edge taken along lines 3—3 showing the manner in which the flashing strips float in the flashing channel.

FIG. 5 is a top view of another embodiment of the invention showing a different dome shape and also showing the manner in which the flashing strips overlap each other from top to bottom.

FIGS. 6*a–c* are plan views of various embodiments wherein the shapes of the dome or domes in the upper pane are varied.

DETAILED DESCRIPTION OF THE INVENTION

Figure 1:
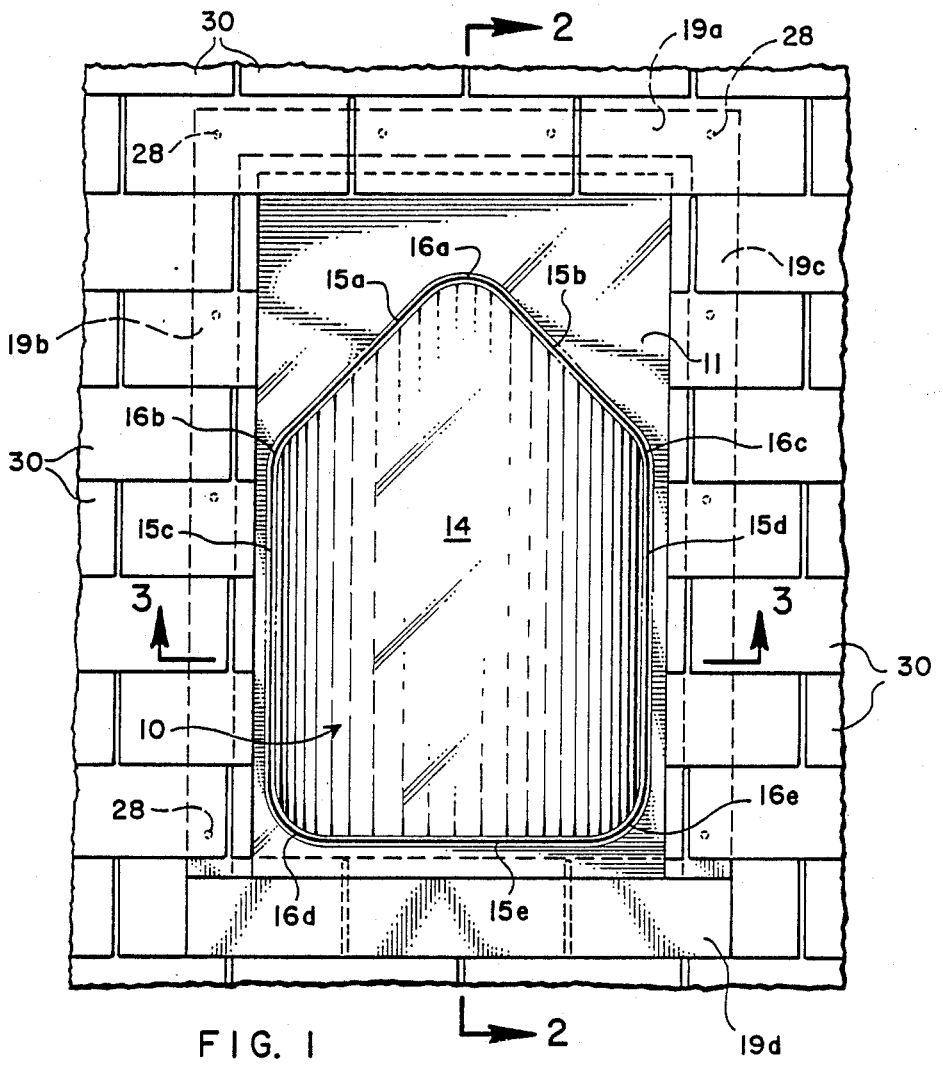
FIG. 1 is a plan view of an installed skylight showing the preferred dome shape.
Figure 2:
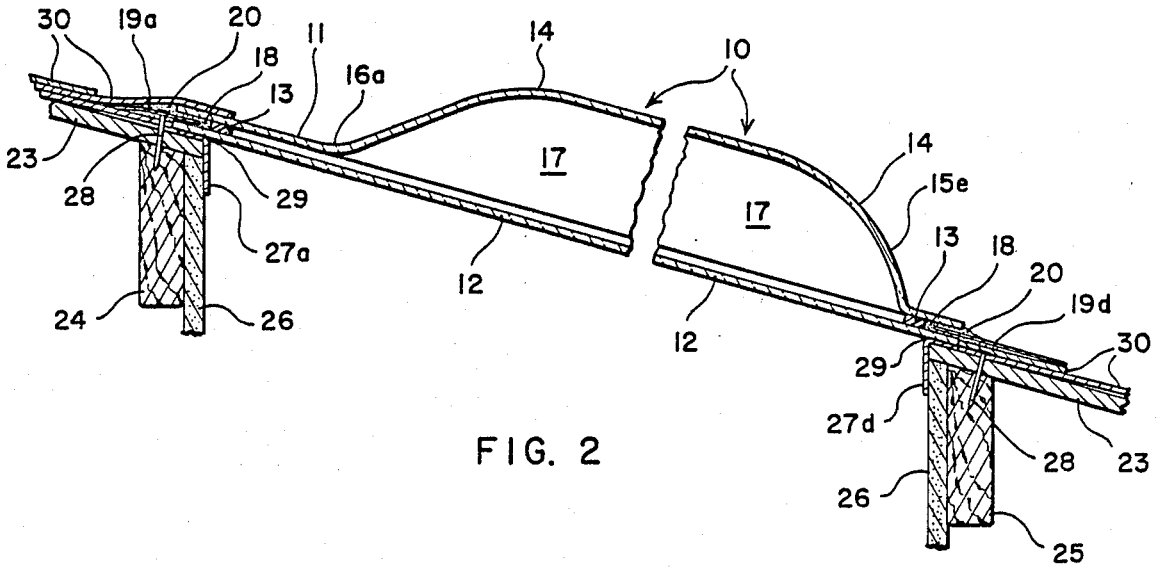
FIG. 2 is a longitudinal cross sectional view taken along lines 2—2 of FIG. 2.

There is shown in FIGS. 1–4 one complete and preferred embodiment of the invention. FIGS. 1–3 show a skylight 10 consisting of upper pane 11 and a lower pane 12 separated by a continuous spacer 13. Panes 11 and 12 are generally rectangular in shape having opposing side edges and a top and bottom edge. Upper pane 11 contains a dome 14. The preferred dome shape, as shown in FIG. 1, generally has five sides 15*a–e* connected by rounded corners 16*a–e*. The dome 14 is formed by the central portion of pane 11 depending upwardly and inwardly from the walls and corners. As shown in FIG. 1, a generally rounded forward corner 16*a* has sides 15*a* and 15*b* angling outwardly and backwardly therefrom toward the sides of the pane terminating at rounded corners 16*b* and 16*c*. From rounded corners 16*b* and 16*c*, sides 15*c* and 15*d* depend backwardly and parallel to the side edges of upper pane 11 to corners 16*d* and 16*e* which, in turn are interconnected by backside 15*e* which is parallel to the lower edge of pane 11. Other dome shapes may be utilized. However, the shape just described is deemed to be the most functional as will be described below.

The spacer 13 is located inwardly from the outside perimeters of panes 11 and 12 a predetermined distance but must be located outwardly from dome 14. Spacer 13 is located parallel to the side and end edges of the panes and forms a continuous barrier. Inside of the barrier between the upper and lower panes is a dead air space 17 and outside the barrier between the panes is a flashing channel 18. Spacer 13 may be made in the form of strips or may be one piece. It is sandwiched between the panes and fixed in place by adhesives or other suitable means to create a water tight seal.

The distance spacer 13 is located inwardly from the outside edges of panes 11 and 12 will be determined by the depth desired for flashing channel 18.

Panes 11 and 12 and spacer 13 may be made of any suitable light transmitting material, and may be transparent or translucent. Preferably a high impact acrylic or polycarbonate type of translucent plastic will be used such as marketed under such tradenames as Lexan and Plexiglas. It is also preferable that both panes and the spacer be made from the same plastic material so they will have the same coefficient of thermal expansion.

Flashing channel 18 runs around the entire outer perimeter of skylight 10 defined by spacer 13 and the portions of panes 11 and 12 extending outwardly therefrom. Into this channel is inserted flat strips of flashing material 19 which may be made of any suitable material such as aluminum, steel, galvanized tin, plastic and the like. The flashing 19 is held in channel 18 by means of a resilient sealing matrix 20. This may be any suitable caulking or mastic type of substance made of plastic or asphaltic compositions. Flashing 19 is preferably not inserted into channel 18 at a depth to be in contact with spacer 13. Rather, a small space is left between the flashing 19 and spacer 13 and filled with the matrix to allow for thermal expansion and contraction of panes 11 and 12.

FIG. 4 is more explicit in showing how flashing 19 is held in channel 18 surrounded by matrix 20.

Flashing 19 is preferably made of strips 19*a–d* as best shown in FIG. 5. Upper strip 19*a* overlaps side strips 19*b* and 19*c* which, in turn, overlap bottom strips 19*d* much in the same manner as roof shingles overlap each other on a downward slope. This prevents water running over the flashing from seeping under the various flashing strips on a downward course. However, in the alternative, flashing 19 could be made of a single continuous strip. In that case, to install the flashing, spacer 13 would have to be sealed to one pane, the flashing would then be inserted about the spacer and the second pane would then be sealed to the spacer. The matrix would be appropriately applied into the flashing channel at any suitable point of the joining operation.

Flashing strips 19 extend outwardly from channel 18 a predetermined distance to provide for installation of the skylight 10 and the sealing of the same against leakage.

FIGS. 1–3 also show the manner in which the skylight may be installed. Assuming one is starting with an existing roof, an appropriate sized opening is created by cutting through the shingles and sheathing. Preferably the skylight will be of a width that it will fit between adjacent rafters 21 and 22 as shown in FIG. 3 with the outer edges, from about the spacer 13 and out, resting on the sheathing 23 over the rafters. If desired, as shown in FIG. 2, an appropriate top header 24 and bottom header 25 may be secured between the rafters below the sheathing 23 for framing purposes. With the opening framed as described, the skylight shaft may be completed by the placement of drywall 26.

Although not absolutely necessary, it is preferable to surround the opening with a metal frame before installing the skylight 10. An appropriately angled frame 27 is placed over the sheathing 23 and down the sides of the drywall 26. As shown in FIG. 3, the frame sides 27*b* and 27*c* are at a 90° or right angle. As shown in FIG. 2, the top frame end 27*a* is at an obtuse angle and the bottom frame end 27*d* is an acute angle. The angles will, of course, depend upon the pitch or slope of the roof. The frame may be made in strips or of a single piece and is appropriately secured around the opening by nails, adhesives and the like.

Before placing the skylight 10 over the opening, a continuous bead of silicone or other appropriate sealant 29 is placed on the upper surface of frame 27. The outer edges of lower pane 12, from about spacer 13 and out, are then positioned over the silicone bead and the outer edges of the skylight are pressed to create a seal between the frame 27 and the lower pane 12. Some sealant 29 may extend out past the edge of the pane to underlie outwardly extending flashing 19. If desired, additional sealant 29, or mastic, may be placed on the sheathing outside of frame 27 to provide a sealant under the flashing. The flashing 19, extending outwardly over the sheathing 23 is then secured to the roof by nails 28. Preferably the flashing 19 will be positioned over the rafters 21 and 22 and headers 24 and 25 so that the nails 28 will be secured through the sheathing and into the framing. When secured in this position, the flashing will not move relative to the roof. However, the skylight is permitted to thermally expand and contract relative to the flashing 19 in the flashing channel 18 as best shown in FIG. 4. The silicone seal 29 does not inhibit the small amount of thermal expansion or contraction which will take place. However, no leakage occurs between the flashing and skylight due to the sealing matrix 20 holding the flashing 19 in channel 18.

When the flashing has been nailed to the roof, the installation can be completed by proper placement of shingles 30 around the skylight in the manner shown in FIGS. 1–3. Assuming, for purposes of illustration, the placement is of 12" shingles having a 7" overlap and 5" exposure. Preferably, the bottom edge of lower flashing **19*d* will be in alignment with the lower edge of a row of shingles as shown in FIG. 1. Each ascending row of shingles will extend over side flashing strips 19*b* and 19*c* at the sides of the skylight nd also extend over the upper side perimeter surface of pane 11 in the manner shown in FIGS. 1 and 3**. If desired, a mastic or other sealant can be placed over the flashing before shingling to create a tighter seal.

As will be noted from FIGS. 1 and 2, the lower flashing **19*d* serves as part of the shingle structure in that it overlaps the lower row of shingles involved in the placement of the skylight and covers the nails used in securing that row of shingles. Hence, there is no need to cover the lower flashing 19*d*** with shingles.

As shown in FIGS. 1 and 2, when the upper involved row of shingles is reached, the lower edge of the shingles in that row will overlap the upper flashing **19*a* and also the upper perimeter edge of pane 11. Thus, when completely installed, the self-flashing skylight 10 will be flush mounted in the roof and water coursing down the roof will not meet any abutment, other than the skylight dome, to cause any water backup or seepage under any shingle or portion of the skylight. The shape of the dome shown in FIGS. 1–3 minimizes any impediment in water flow. Water will be diverted away from the dome at rounded front corner 16*a*, flow at an angle down sides 15*a* and 15*b* to corners 16*b* and 16*c* and off onto the roof. Water not flowing to the roof at the sides of the skylight will then flow down past sides 15*c* and 15*d* and off the lower portions of side flashing 19*b* and 19*c* and bottom flashing 19*d*** onto the roof.

Rain falling directly on doom 14 will drain by gravity and fall from the edges and bottom in the manner just described.

Other dome shapes may also be utilized. FIG. 5 shows a skylight 10 having a dome 14 symmetrically shaped. Other shapes are shown in FIGS. **6*a–c***.

FIG. **6*a* shows skylight 10 having a spherical dome 14. FIG. 6*b* illustrates a skylight 10 having downwardly sloping parallel prism shaped domes 14*a* and 14*b* wherein the domes are formed from upwardly and inwardly sloping sides 15*f* and 15*g* meeting at an apex and sloping ends 15*h* and 15*j* which are sealed to the sides to complete the dome. FIG. 6*c* shows a skylight 10 having a cylindrical dome 14 with a pointed slanted front end 15*k* and an arcuate sloped back end 15*m***.

Obviously other modifications may be made without departing from the scope of the invention. The bottom pane does not necessarily have to be flat and can parallel the shape of the dome in the upper pane. Also, while preferable to have a dome, the upper pane could be flat. Multiple skylights can be placed side by side with reinforcement between the skylights. These modifications and other functional equivalents are deemed to be part of the invention which is to be limited only in scope by the appended claims.

I claim:

1. A self flashing dual pane skylight for flush mounting on a roof having an inclined slope, said skylight comprising;

(a) an upper light transmitting pane having two mutually opposed parallel side edges and opposed top and bottom edges and containing a convexly curved central dome portion extending between said mutually opposed side edges and opposed top and bottom edges;

(b) a lower light transmitting pane having the same perimeter dimensions as the upper pane, said upper and lower panes being generally rectangular in shape;

(c) spacer means secured between said upper and lower panes parallel to the outer perimeter edges thereof and spaced inwardly therefrom a predetermined distance thereby forming a dead airspace between said upper and lower panes inwardly of said spacer means and a flashing channel around the outer perimeter between said panes outwardly of said spacer means;

(d) flat flashing means secured in said flashing channels by a resilient sealing matrix in a free floating relationship allowing said upper and lower panes to thermally expand and contract relative to said flashing means without altering the position of said flashing means when secured to said inclined roof, said flat flashing, means being separated from said spacer means by said resilient sealing matrix, said flat flashing means comprising a body portion and a free edge portion, said body portion extending outwardly therefrom a predetermined distance in a plane parallel to said lower light transmitting pane, and said free edge portion lying in the same plane as said body portion to form a continuous flat flashing border for attaching said skylight to said roof, said flashing means being in the form of strips with a strip being positioned in each of the flashing channels along the upper perimeter edge, both side perimeter edges, and the lower perimeter edge of said skylight, said flashing strip in said channel along said upper perimeter edge overlapping the flashing strips positioned in said channels along side perimeter edges and said flashing strips in said channels along said side perimeter edges overlapping the flashing strip in said channel along said lower perimeter edge.

2. A skylight according to claim 1 wherein said upper and lower panes and said spacer means are constructed of a high impact plastic material.

3. A skylight according to claim 2 wherein said upper and lower panes and said spacer means are all constructed of the same plastic material.

4. A skylight according to claim 2 wherein said convexly curved dome portion of said upper pane is five sided, two of said sides being parallel, with each side of said dome portion being joined to adjacent sides by rounded corners, said convex portion being oriented such that said parallel sides are parallel to the side edges of said upper pane one other side being at right angles to said parallel sides and parallel with the bottom edge of said upper pane, with the remaining two sides being angled forwardly and toward each other and being joined at a rounded corner midway between said side edges of said upper pane and near the top edge thereof, said sides and rounded corners depending upwardly and inwardly to merge and form said convexly curved dome portion.

5. A skylight according to claim 4 wherein said convexly curved dome portion is shaped such that said parallel sides have a length greater than the length of said side positioned at right angles thereto.

6. A skylight according to claim 1 wherein the width of said skylight is such that the parallel side perimeter edges of said flashing channel and the flashing contained therein, will fit over adjacent rafters on an inclined roof such that said skylight can be flush mounted on said inclined roof between said adjacent rafters.

* * * * *